US010486864B2

(12) United States Patent
Van Goolen

(10) Patent No.: US 10,486,864 B2
(45) Date of Patent: Nov. 26, 2019

(54) CLOSING ELEMENT

(71) Applicant: Save-Ty Can Cap B.V., Galder (NL)

(72) Inventor: Corstiaan Johannes Van Goolen, Hoogblokland (NL)

(73) Assignee: Save-Ty Can Cap B.V., Galder (NL)

( * ) Notice: Subject to any disclaimer, the term of this patent is extended or adjusted under 35 U.S.C. 154(b) by 412 days.

(21) Appl. No.: 15/022,736

(22) PCT Filed: Sep. 18, 2014

(86) PCT No.: PCT/NL2014/050642
§ 371 (c)(1),
(2) Date: Mar. 17, 2016

(87) PCT Pub. No.: WO2015/041528
PCT Pub. Date: Mar. 26, 2015

(65) Prior Publication Data

US 2016/0229596 A1 Aug. 11, 2016

(30) Foreign Application Priority Data

Sep. 18, 2013 (NL) ..... 2011467
Feb. 7, 2014 (NL) ..... 2012230

(51) Int. Cl.

| | |
|---|---|
| ***B65D 39/08*** | (2006.01) |
| ***B65D 39/10*** | (2006.01) |
| ***B65D 39/12*** | (2006.01) |
| ***B65B 7/28*** | (2006.01) |

(52) U.S. Cl.
CPC ..... *B65D 39/082* (2013.01); *B65D 39/088* (2013.01); *B65D 39/10* (2013.01); *B65D 39/12* (2013.01); *B65B 7/2892* (2013.01)

(58) Field of Classification Search
CPC .... B65D 39/082; B65D 39/088; B65D 39/10; B65D 39/12; B65D 17/50
See application file for complete search history.

(56) References Cited

U.S. PATENT DOCUMENTS

| | | | | |
|---|---|---|---|---|
| 1,192,417 A | | 7/1916 | Griffin | |
| 3,177,014 A | | 4/1965 | Bergstrom | |
| 3,214,881 A | | 11/1965 | Thomas | |
| 3,249,268 A | | 5/1966 | Nikolaus | |
| 4,239,132 A | * | 12/1980 | Mueller | B05B 11/004 215/11.3 |
| 4,776,486 A | | 10/1988 | Mizusawa | |

(Continued)

FOREIGN PATENT DOCUMENTS

DE 202009011459 12/2009

*Primary Examiner* — Jeffrey R Allen
(74) *Attorney, Agent, or Firm* — Marcus C. Dawes

(57) ABSTRACT

The invention relates to a closing unit for a throughflow opening of a container or conduit, the closing unit comprising:

a first closing element (4) configured to be mounted or integrally formed on the container or conduit, wherein the first closing element comprises a receiving part provided with a passage and to be arranged in or round the throughflow opening;

a second closing element (6) comprising a closing part configured to be received by the receiving part and to be coupled releasably thereto for the purpose of closing or leaving clear the throughflow opening; wherein the releasable coupling between the receiving part and closing part comprises a conical threaded coupling.

18 Claims, 19 Drawing Sheets

(56) References Cited

U.S. PATENT DOCUMENTS

| | | | | |
|---|---|---|---|---|
| 5,443,175 | A * | 8/1995 | Kelly | B65D 17/506<br>220/212.5 |
| 6,015,054 | A * | 1/2000 | King | B65D 41/0471<br>215/252 |
| 2004/0155040 | A1 | 8/2004 | Stolzenfeld | |

* cited by examiner

CLOSING ELEMENT

The present invention relates to a closing unit for a container or a conduit. The invention also relates to a container or conduit into which such a closing unit is integrated and to a method for arranging such a closing unit on such a container or conduit.

The container can be suitable for storing random liquid or gaseous substances or solid substances. A container can for instance be formed by a bottle, flask, a car radiator, an oil reservoir of an engine, a petrol tank or the like. The closing unit can also be used to close a throughflow opening of a conduit (including a random hose, tube, pipe, channel and the like) or a throughflow opening between two conduits (wherein the closing unit functions as connection between the conduits).

Numerous different types of container are known for the purpose of storing liquid substances, in particular optionally carbonated beverage, or solid substances including particles which can be sprinkled or poured. A commonly used type of container is a beverage can. Cans are substantially cylindrical containers of metal (particularly tin), wherein a metal press-in tab is mounted in one of the end walls of the container which serves as temporary closure of the drinking or pouring opening formed in the container.

Such a closure of a can is generally known and is applied in substantially all beverage cans. A drawback of the known closure is that, once the press-in tab has opened the pouring or drinking opening, this opening can no longer be closed. Once the can has been opened, it must thus in general be wholly emptied, and safe storage of the content of an already opened can is not readily possible in practice. In order to obviate this drawback constructions have been proposed in which the closing element is embodied such that it can reclose the drinking or pouring opening.

These constructions practically all have the drawback however that the closure is not always very effective, and leakage may therefore occur. The closures are moreover often only suitable for closing the container when carbonated beverage is not arranged in the container. If a container with a carbonated content is shaken, for instance during transport (for instance distribution) of the beverage, a great pressure build-up can occur in the container such that the closure tends to start leaking. There can also be a high rise in the pressure in the container (for instance up to 5 atm or higher) in the manufacturing process and/or the filling process of such containers, for instance during a possible pasteurization step. It has not proven readily possible heretofore to realize an effective and simple closure which can withstand such pressures, also when the closure is repeatedly opened and closed.

It is the object of the present invention to provide an improved closing unit for a container, wherein at least one of the above stated drawbacks and/or other drawbacks of the prior art are obviated.

It is also an object of the invention to provide a container with an integrated closing unit wherein at least one of the drawbacks of the prior art and/or other drawbacks are obviated.

It is a further object or the invention to provide a reclosable closing unit suitable for containers with content under high pressure, for instance 2 atm or higher.

According to a first aspect of the present invention, a closing unit for a throughflow opening of a container or conduit is provided, the closing unit comprising:

- a first closing element configured to be mounted or integrally formed on the container or conduit, wherein the first closing element comprises a receiving part provided with a passage and to be arranged in or round the throughflow opening;
- a second closing element comprising a closing part configured to be received by the receiving part and to be coupled releasably thereto for the purpose of closing or leaving clear the throughflow opening;

wherein the releasable coupling between the receiving part and closing part comprises a conical threaded coupling.

The first and second closing elements can be configured here to be mounted or formed on respectively a first and second conduit. The first closing element can also be configured to be mounted or formed on a container, in particular a beverage container such as a can or a bottle, wherein the throughflow opening of the container is a drinking or pouring opening. The screw thread of the threaded coupling can be single-thread or multi-thread. The threaded coupling can for instance comprise one or more spiral-shaped ridges or elevations embodied to couple the closing part and receiving part to each other by clamping. Because use is made of the threaded coupling with conical parts, a better clamping of the closing part and receiving part can be realized so that the seal between the closing part and receiving part is greatly improved. This improvement of the seal results in the content of the container remaining sealed from the outside world by the closing unit, even at the stated higher pressures.

The desired conicity of the threaded coupling depends on, among other factors, the maximum pressure in the container, the material from which the closing unit is manufactured, the number of threads of the screw thread, the thread overlap and the like. In embodiments of the invention the apex angle (i.e. twice the angle of conicity $\beta$) of the (imaginary) cone of the conical screw thread amounts to between 5 and 15 degrees or even between 8 and 10 degrees. With such an apex angle it is found possible to realize a reliable seal with a relatively short rotation of the closing part.

Provided according to another aspect of the invention is a closing unit for a throughflow opening of a container or conduit, the closing unit comprising:

- a first closing element configured to be mounted or formed integrally on the container or conduit, wherein the first closing element comprises a receiving part provided with a passage and to be arranged in or round the throughflow opening;
- a second closing element comprising a closing part configured to be received by the receiving part and to be releasably coupled thereto for the purpose of closing or leaving clear the throughflow opening;

wherein the releasable coupling between the receiving part and closing part is a threaded coupling comprising first screw thread formed on the receiving element and second screw thread formed on the closing element, wherein the first and second screw thread is multi-thread screw thread.

Because the screw thread is multi-thread, the forces can be better distributed over the periphery of the receiving part and the closing part, wherein a small unscrewing or screwing angle can nevertheless he realized. The receiving part and the closing part can take a cylindrical form. Use is preferably made however of conical screw thread wherein the receiving part and closing part take a conical form in order to increase the measure of sealing as set forth above.

In a further embodiment the multi-thread screw thread is embodied to couple or uncouple the closing part and receiving part over substantially the whole periphery with a rotation of the closing part and receiving part relative to each other over an angle of less than 180 degrees, preferably less than 90 degrees, still more preferably less than 50 degrees. A combination of a very small coupling angle and uncoupling angle (unscrewing and screwing angle) and a nonetheless high measure of closure can hereby be realized. The closing unit can further be configured to slide the closing part and the receiving part apart in axial direction in the fully uncoupled position. The closing part and the receiving part can likewise be slid together axially, following which a rotation through only a relatively small angle results in complete mutual coupling of the closing part and receiving part.

As set forth, the (single-thread or multi-thread) screw thread of the threaded coupling is arranged to engage on each other over the full periphery of the receiving part and closing part in order to bring about an optimum distribution of the forces and to increase the resistance of the closing unit to high pressures in the container. In other words, the parts of the screw thread are at least fully supporting (once or more than once) in peripheral direction, this making the closing unit more suitable for absorbing a relatively high pressure in the container.

In the case of single-thread screw thread the screw thread extends over at least 360 degrees in peripheral direction, while in the case of double-thread screw thread an angle of at least 180 degrees suffices. When n-thread screw thread (wherein n=1,2,3, . . . ) is applied, the screw thread more generally has to extend over at least (360/n) degrees in peripheral direction in order to bring about engagement over at least the whole periphery. In an embodiment of the invention the screw thread takes a four-threaded form.

In embodiments of the invention the closing unit is embodied such that the unscrewing angle (0), i.e. the minimum angle through which the second closing element must be rotated so that it can be removed in axial direction, is approximately equal to:

$$\theta=(O*180°)/(S*\tan(\beta)),$$

wherein S is the thread pitch [in mm], β is the angle of conicity (i.e. the half-apex angle) [in degrees], O is the thread overlap, i.e. the overlap between the two screw threads in radial direction [in mm], and n is the number of threads or the multiplicity of the thread. In determined embodiments, for instance an embodiment in which the closing unit is embodied for the purpose of closing a beverage can, the angle of conicity β is roughly equal to 10 degrees, the pitch S is roughly equal to 12 mm, the thread overlap is roughly equal to 0.5 mm and the multiplicity is equal to 4, so that the unscrewing angle θ is roughly equal to 42.5 degrees.

In further embodiments of the invention the threaded coupling takes a self-braking form. "Self-braking" is understood here to mean that, substantially irrespective of the magnitude of the axial force exerted on the closing element, the closing element will not unscrew of its own accord. The threaded coupling is for instance self-braking when the average entry angle or lead angle (α) of the screw thread is selected such that the effective coefficient of friction between the screw thread of the first closing element and the screw thread of the second closing element (for instance the male and the female screw part) is just slightly larger than the tangent of this lead angle. The average lead angle is defined here as follows:

$$\alpha=\arctan(\text{pitch } S/(\pi*\text{average screw thread diameter})).$$

In embodiments of the invention the closing unit is embodied so that the term (pitch S)/(π* average screw thread diameter) is slightly smaller than the effective coefficient of friction. In a further embodiment this term is plus/minus 25% smaller. When the seal incorporated in the closing element causes substantial friction, a value which is slightly too large will also suffice.

In embodiments of the invention the entry angle (α) can therefore be roughly equal to arc tangent (f) plus or minus 25%, wherein f equals the effective coefficient of friction between the two screw thread parts, in particular between the two overlapping thread parts which support on each other or lie against each other.

In embodiments of the invention the closing part of the second closing element comprises a substantially annular downward extending part with external screw thread on the outer side. This annular part can engage for instance with the external screw thread into a corresponding annular part of the receiving element of the first closing element. The downward extending part is preferably manufactured from flexible material. When the downward extending part is manufactured from somewhat flexible material and comprises a hollow space which in the closed situation is connected to the volume of the container, the screw thread of the closing part is pressed radially outward as a result of the pressure. The external screw thread will then be pressed still more firmly against the receiving element so that the seal can be improved.

The closing unit is preferably manufactured from plastic. Polypropylene or a similar material can be applied as flexible plastic material. It is further recommended to manufacture all components, at least the most important components, of the closing unit in an injection moulding process.

In an embodiment of the invention the lead angle or entry angle (α) of the screw thread varies from a relatively high value close to the free outer end of the closing part and a relatively low value at the opposite outer end of the closing part. When the screw thread takes for instance a conical form, this may mean that the pitch of the threaded coupling remains (substantially) constant along the height of the closing element (and of course also of the receiving element). When the closing part is now screwed more tightly or more loosely, or rotated slightly further or less far, at a constant pitch all threads will make uniform contact over their full "length" and over the whole "overlap zone". This provides the advantage of a uniform distribution of tension over the whole (active) screw thread, this being favourable in being able to absorb great axial forces resulting from pressure differences.

In further embodiments of the invention the thread overlap in radial direction (O) of the first and second screw threads amounts to between 0.4 and 1.0 mm, preferably between 0.5 and 0.6 mm. In further embodiments the (preferably constant) pitch (S) of the screw thread can amount to between 8 and 20 mm.

Provided according to another aspect is a method for arranging a closing unit, the method comprising of:

- bending the peripheral edge all around the opening in the container;
- sliding a part of the closing unit or the whole closing unit into the opening;
- bending back the peripheral edge and pushing the peripheral edge partially or wholly into the side of the closing unit in order to attach the closing unit to the container.

The invention will be elucidated on the basis of the following description of several embodiments thereof. Reference is made in the description to the accompanying figures, in which.

Figure 1:
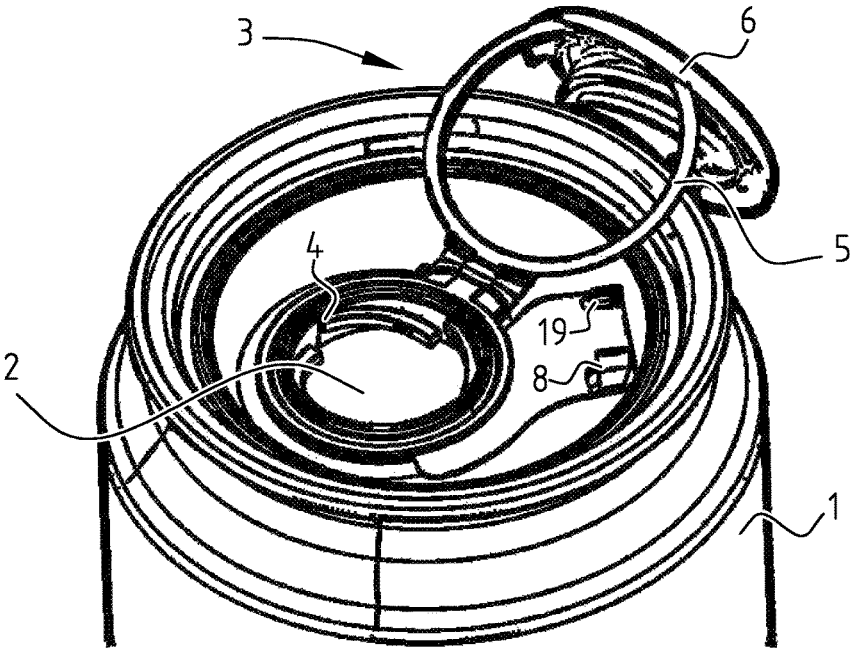
FIG. 1 is a perspective view of a first embodiment of the closing unit of the invention arranged in a beverage container in the wholly opened position of use.

FIGS. 1-10 show a first embodiment of the invention. The figures show a container 1 for storing liquid substances, in particular optionally carbonated beverage, or solid substances. The beverage container can for instance consist of a can, (PET) bottle, cardboard packaging and the like. Arranged in the upper end surface of container 1 is an opening 2 along which the content of the beverage container can be discharged. The opening can be closed with a closing unit 3 according to a first embodiment of the invention.

In the shown embodiment closing unit 3 is constructed from (at least) a first closing element 4 (also referred to as lower element) and a second closing element 6 (also referred to herein as upper element). Further provided in this embodiment is an intermediate element 5 between the first and second closing elements. The middle element or intermediate element 5 forms a mutual connection for the first and second closing elements and ensures that, when the closing unit is opened, second closing element 6 nevertheless still remains connected to the first closing element and cannot therefore be lost. Both the closing elements and the intermediate element can be separate components which are embodied for coupling to each other, or can be integrated with each other. In other embodiments the first and second closing elements are not connected to each other via an intermediate element.

The first (lower) closing element 4 is attached to beverage container 1, upper element 6 (also referred to here as the cap) forms the actual closure and intermediate element 5 serves to connect the cap and the first (lower) closing element, and ensures that in principle the cap thus remains always connected to the beverage container.

The first (lower) closing element 4 can be manufactured integrally in determined embodiments. In other embodiments, for instance the embodiment of FIGS. 1-9, first closing element 4 comprises a lower element part 34 which is held against the inner side of the end wall of the container, and an upper element part 47 which is held against the end wall from the outside. Upper and lower element parts 34,47 can be coupled to each other in order to fix first closing element 4 firmly to the end wall of the container.

Second closing unit (cap) 6 has a tongue 7 with which it can be easily grasped in order that it can be rotated so as to open the closing unit. In the opened position the tongue 7 can further be grasped in order to pull cap 6 upward and position it out of the drinking plane. The upper side of cap 6 has a slightly recessed surface in order to safeguard imprints against damage when the beverage container is placed on its head, for instance during the filling process and during printing of the underside, such as arranging best-before dates. Cap 6 also has a protective part 11 (FIG. 2) for covering the underlying construction, for instance for the purpose of protecting it from dirt and the like. Cap 6 is provided on its underside with a substantially annular downward extending part 28. Arranged on the outer side of the downward extending part is external screw thread 26, preferably of the type which is in principle conical and/or is embodied as combined threaded bayonet coupling.

When the cap is rotated sufficiently far (in direction 20), for instance through an angle of about 40 degrees, tongue 7 automatically moves upward as a result of the presence of the threaded bayonet connection, and space is hereby left clear to further grasp the tongue 7 and fold it open.

Figure 8:
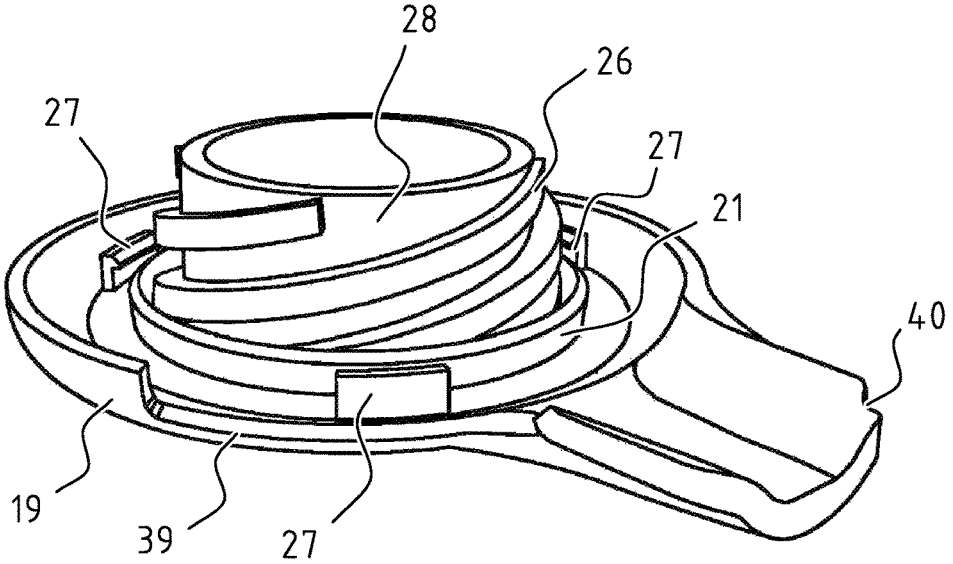
FIG. 8 is a perspective bottom view of the upper element (cap) with tongue.
Figure 9:
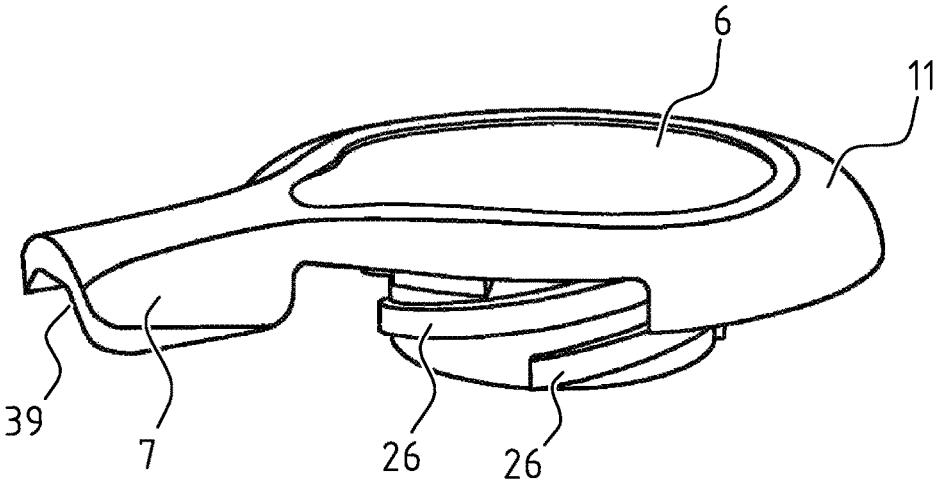
FIG. 9 is a perspective top view of the cap with tongue.

As shown for instance in FIG. 8, cap 6 has an open or removed portion 39. This portion is open in order to create space for the bistable hinge 10. Cap 6 is further provided on the underside with a number of fingers (or snap members) for the purpose of attaching the cap 6 to third element part 16. A piece of sealing material (lip seal) can, in combination with an upright edge or collar of the first (lower) closing element, provide for a good seal.

Figure 2:
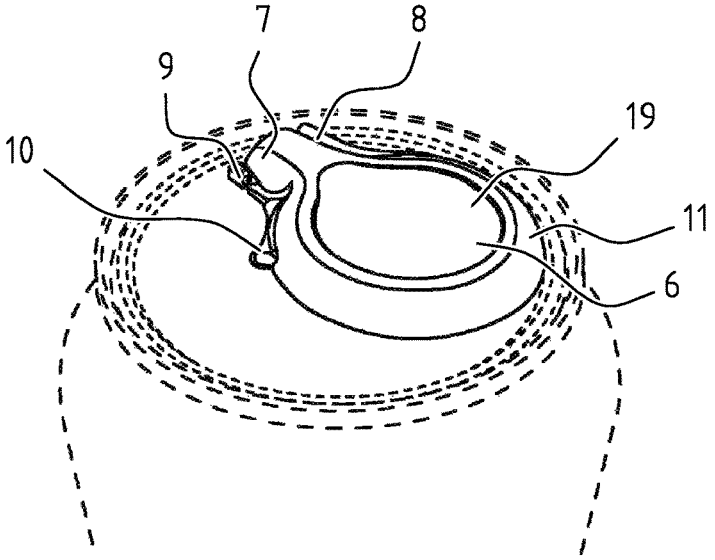
FIG. 2 is a perspective view of the beverage container with closing unit of FIG. 1 in a closed position.
Figure 3:
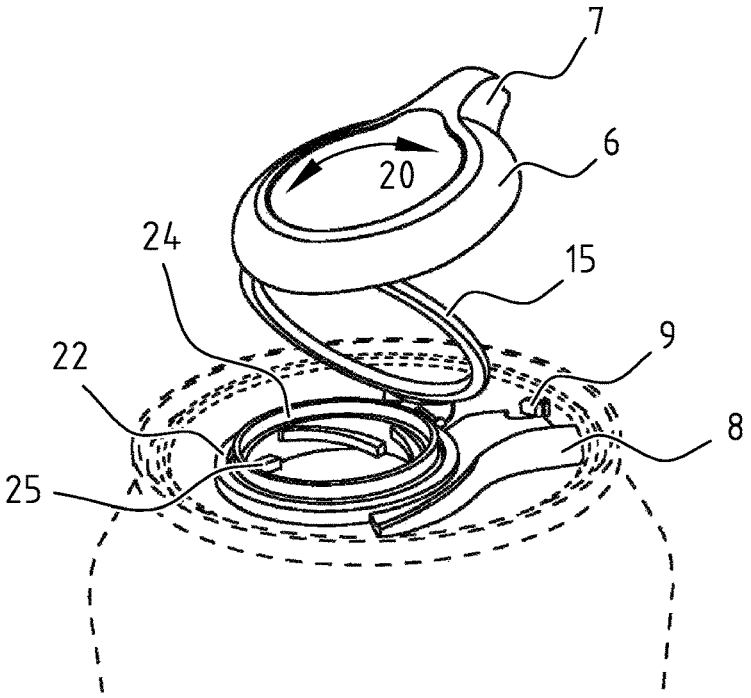
FIG. 3 is a perspective view of the beverage container with closing unit in an intermediate position folded half-open.
Figure 4:
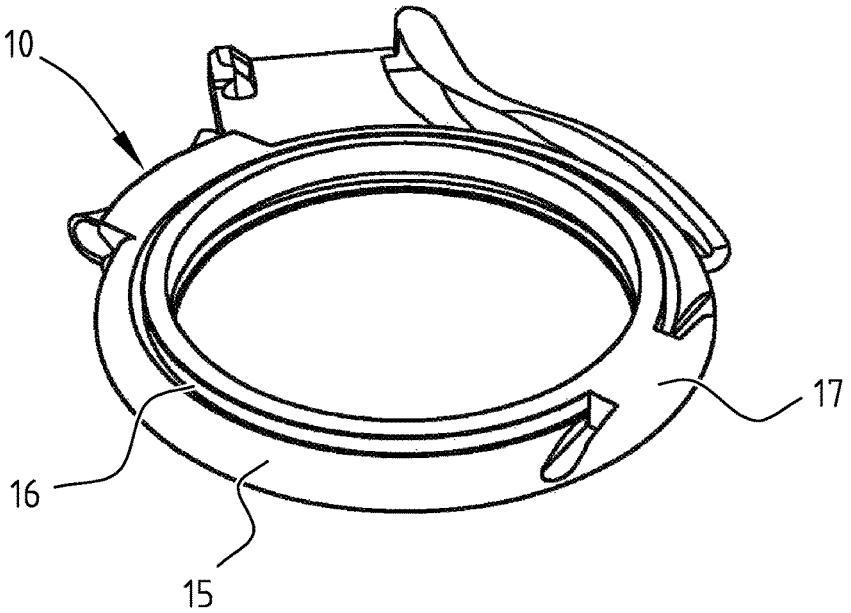
FIG. 4 shows a view of the intermediate element without upper element (cap) and in wholly folded shut (closed) position.

Referring to FIG. 2, intermediate element 5 comprises three substantially annular element parts. First element part 14 is attached to first (lower) closing element 4, second element part 15 is mounted hingedly on the first element part via a hinge 10 and third element part 16 is mounted hingedly on second element part 15 via a hinge 17. Hinges 10 and 17 are positioned opposite each other here so that the three element parts can pivot harmonica-wise relative to each other. The second closing element (cap) 6 can be attached to third element part 16. The attachment is such here that cap 6 can rotate (in direction 20, FIG. 3) relative to the annular third element part 16, as will be further explained below. First (lower) closing element 4 can be attached to or formed on first element part 14.

Figure 6:
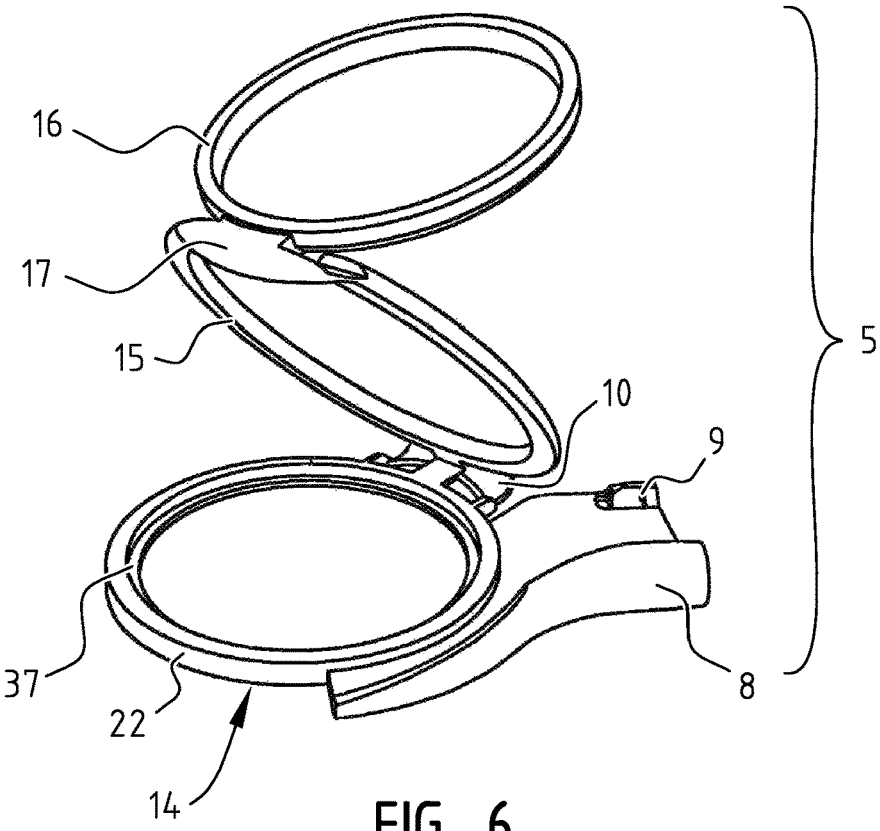
FIG. 6 shows a view of the intermediate element without cap and in folded-open position with the annular third element part in which the cap is clamped in folded-up position.

FIG. 6 shows that a cover 8 is arranged on first element part 14 of intermediate element 5. A part of the (screw/pull-) tongue 7 can be accommodated herein in order to prevent the possibility of tongue 7 being pulled upward before it has been rotated. Reference numeral 9 designates an anti-tamper construction. This partially breaks off when cap 6 is rotated and thereby makes the user immediately aware of whether the closing unit has been tampered with.

The hinge 10 arranged between first and second element parts 14,15 can be embodied as a bistable hinge. Bistable is understood to mean a construction wherein the hinge has a tendency to remain either in a wholly opened or wholly closed position. When the cap is opened, it will thus tend to remain open. This enhances the convenience of use of the closing unit. In a determined embodiment the hinge is for instance embodied so that, when the intermediate element has been pivoted more than half-open, this closing unit also remains open, even when the beverage container is for instance held askew.

Figure 5:
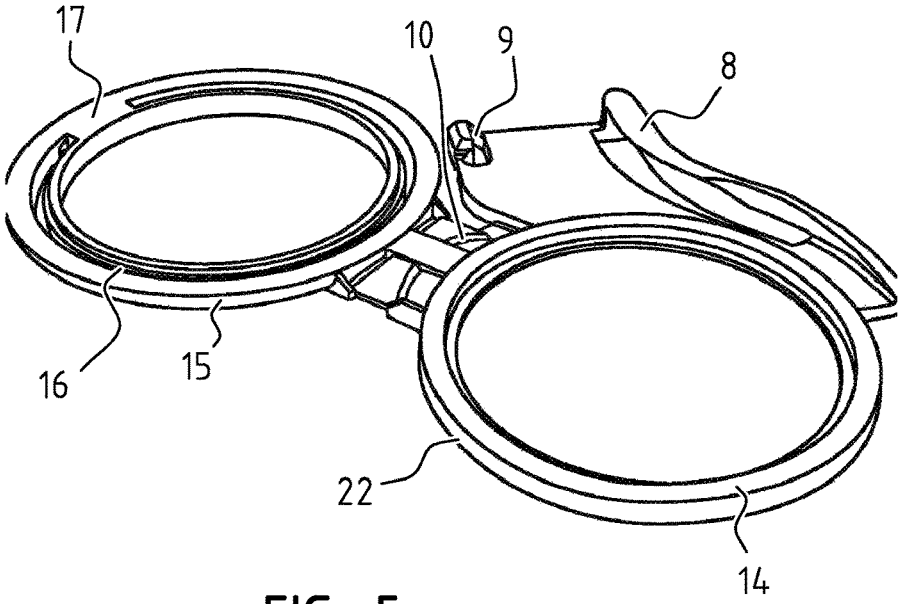
FIG. 5 shows a view of the intermediate element without cap and in folded-open position, but with the annular third element part in which the cap is clamped in flat position.
Figure 7:
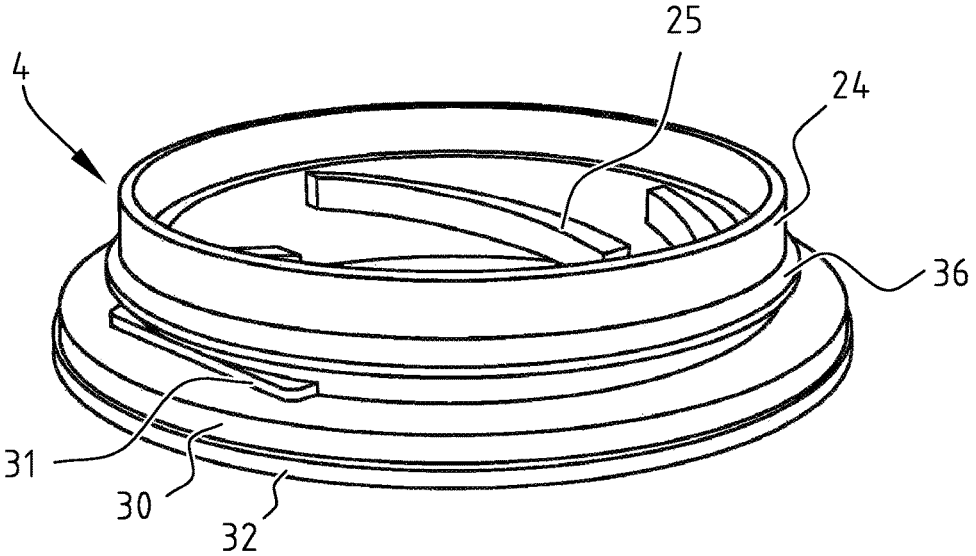
FIG. 7 is a perspective view of the substantially annular first (lower) closing element.

First element part 14 of intermediate element 5 comprises a ring 22 (FIG. 5). This ring can be attached, for instance via a snap connection, to an annular part of first (lower) closing element 4 protruding upward through the opening (FIGS. 6,7). The attachment is such that first (lower) closing element 4 is pulled against the end wall of the beverage container in order to ensure a good closure. First (lower) closing element 4 comprises for this purpose an annular upright part 24 (FIG. 4) provided on the inner side with conically embodied bayonet screw thread 25.

In order to provide for a good connection of closing unit 3 to the (metal) upper wall of container 1, lower element part 34 of first (lower) closing element 4 has a lateral flange 32. A relatively soft material, for instance of rubber or silicones, is arranged on the surface of the lateral flange facing toward the end wall of the container. Because lower element part 34 is further tightened via ring 22 of intermediate element 5, a desired sealing can be ensured on the underside of the container wall.

A fitting piece 31 ensures that lower element part 34 cannot co-rotate when the screw/pull cap 6 is screwed open. Upright part 24 of lower element part 34 is provided on the outer periphery with a conically embodied protrusion 36. Together with protrusion 37 of ring 22, the first (lower) closing element 4 can be attached to intermediate element 5, in particular by "snapping" the two elements onto each other so as to thus form one whole. A stable seal is created by the pressure exerted here. Upright part 24, also referred to herein as collar 24, serves as sealing edge of the sealing material (lip seal) incorporated into cap 6.

The bayonet-threaded construction 25,26 is embodied such that in secured position the screw thread 25 of the lower part and screw thread 26 of cap 6 provides support over substantially the whole periphery of collar 24. The screw thread takes a conical form and provides for a strong pulling force over the whole surface which thus ensures a liquid-tight and pressure-tight seal. Also arranged in cap 6 is a small recess 40 for the purpose of arranging tongue 7 in cover 8 without the wall on the end surface getting in the way.

Figure 10:
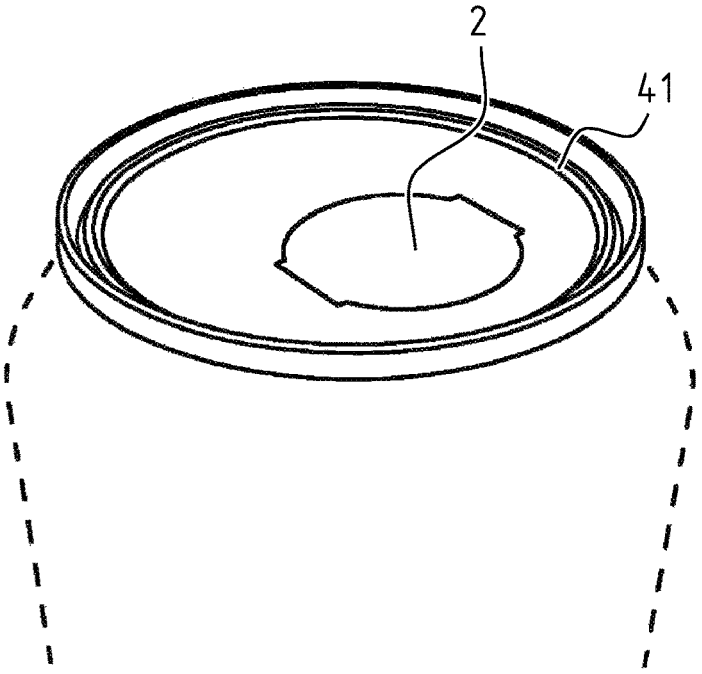
FIG. 10 is a perspective view of the upper side of the beverage container in which the contour and location of the opening in the metal end wall of the beverage container is shown.

FIG. 10 shows metal end wall 13 of container 1 which is placed on the body of the container and secured by means of a seam-folding technique. A lowered end wall surface 41 provides for additional strength in the (metal) surface because the "stretch" is partially removed therefrom. The figure further shows opening 2 with special anti-co-rotation form into which the reverse form of first (lower) closing element 4 drops in order to thus prevent co-rotation of first (lower) closing element 4 when the cap is screwed open.

Figure 11:
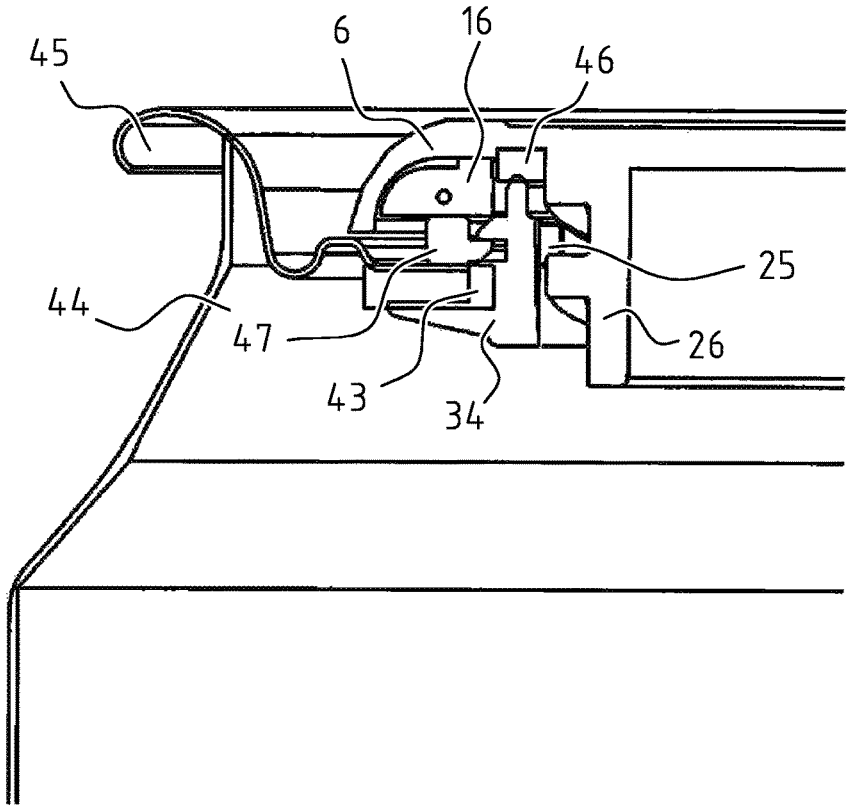
FIG. 11 is a cross-sectional view of a beverage container provided with a second embodiment of the invention.

FIG. 11 shows a further embodiment of the invention. Shown is a quantity of relatively soft sealing material 46 which is arranged on the underside of second closing element (cap) 6 (instead of the above-mentioned lip seal). A further quantity of relatively soft sealing material 43 is arranged on lower element part 34 of first closing element 4 placed against the underside of end wall 45 around the opening therein. Upper element part 47 of first closing element 4 is attached to lower element part 34, for instance by means of a "snap" connection.

The operation of the closing unit is as follows. First (lower) closing element 4 is placed via the underside of the metal surface of the container wall into the specially formed opening 2. Via conical edge 37 on the inner periphery of ring 22 of the intermediate element and the conical edge 26 on collar 24 of first (lower) closing element 4 the intermediate element 5 and first (lower) closing element 4 are coupled (by means of a snap connection) to each other. This results in a pulling/pressing force which presses the soft seal 30 against the (metal) surface of the end wall of the container and thus provides for a liquid-tight and pressure-tight seal.

Intermediate element 5 is provided with a second ring (element part) 15 and a third ring (element part) 16, i.e. a ring 15 and a ring 16 of a smaller diameter which can drop between ring 15. Ring 15 serves as displacing mechanism in order to allow cap 6 positioned in ring 16 to extend so that the cap can be positioned outside the drinking area. Ring 16 further serves as point of engagement of cap 6, wherein the cap can be connected by means of fingers 27 to the ring. Ring 16 has a smaller diameter than ring 15 in order to maintain a minimal height of the whole in folded-down position.

In contrast to known screw thread constructions, which often need two or three complete 360 degree rotation movements to ensure a sufficiently firm closure, the screw thread construction according to embodiments of the invention can achieve a similar closing effect with a much more limited rotation movement, for instance only through an angle of less than 180 degrees, or even less than 120, less than 90 or less than 50 degrees. In determined embodiments the rotation movement (uncoupling angle) is between 20 and 120 degrees, preferably between 30 and 80 degrees and still more preferably about 40 degrees. When the unscrewing angle is so small, the threaded coupling has acquired properties of a bayonet coupling without the usual drawbacks of a bayonet coupling occurring, such as a limited holding force. A great holding force can after all still be achieved through the conical form of the screw thread and/or the use of multi-thread. The coupling according to embodiments of the invention is therefore also referred to here as bayonet screw thread coupling or bayonet screw thread construction.

Lower element part 34 is further provided with an upright collar 24 which serves as closing collar against which the lip seal 2 (FIG. 8) is pressed during closing and rotation of the cap.

Figure 12:
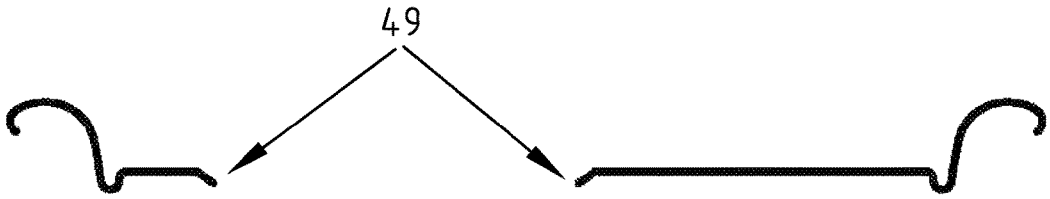
FIG. 12 shows a cross-section through the end surface of a beverage container with modified (drinking) opening.
Figure 13:
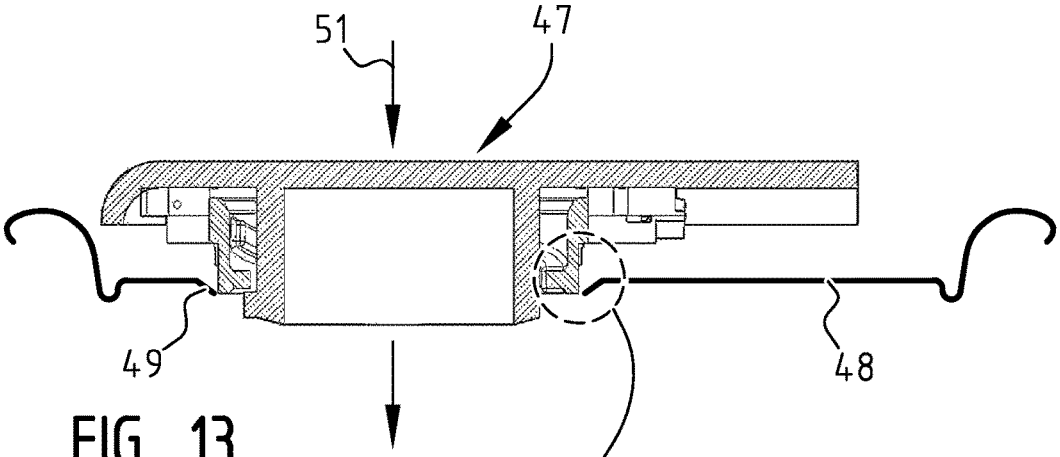
FIGS. 13, 13A show respectively a schematic overview and detail view illustrating the mounting of a third embodiment of the invention in an end surface of a beverage container.
Figure 13A:
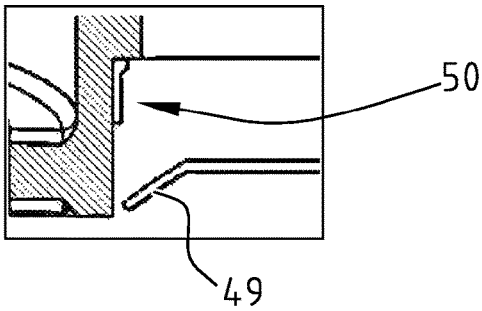
Figure 14:
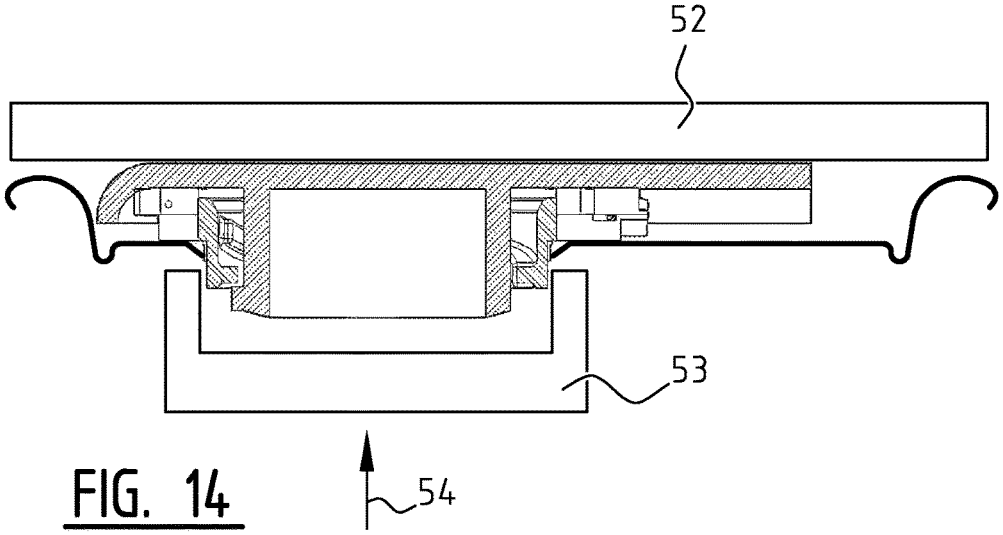
FIG. 14 is a schematic view of a further mounting step.
Figure 15:
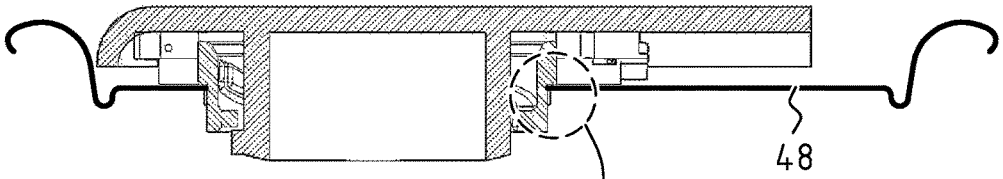
FIGS. 15, 15A show respectively an overview and detail view of the embodiment of FIGS. 13 and 14 in fully mounted position.
Figure 15A:
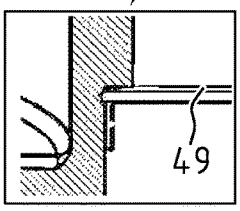

FIGS. 13-15 show a further embodiment of the invention. In the shown embodiment the lower ring is omitted and the upper part of the closing unit is modified to some extent. In this construction the seal is on the outside of the closing unit placed on the end wall in the opening. FIG. 12 shows that peripheral edge 49 around the opening in end wall 48 is bent downward to some extent. A sealing part 50 is provided along the peripheral edge of the closing unit. FIG. 13 shows that closing unit 47 can be pushed from above into the opening (in direction 51). In a following step (as shown in FIG. 14) the above-mentioned peripheral edge 49 is pushed back with a two-part tool (52,53, see FIG. 14) until it extends in line with the rest of the end wall until the assembly end position shown in FIG. 15 is reached. The (metal) bent-back outer end 49 of the end wall now seals against closing part 50 and optionally cuts to some extent into the material of the closing unit. The construction provides for a good seal between the closing unit and the beverage container which is moreover suitable for absorbing the relatively high pressure which can occur in a beverage container.

The closing unit is preferably manufactured from plastic, in particular injection-moulded plastic. The plastic can in general he relatively hard, with the exception of the soft materials of the seals.

Figure 16:
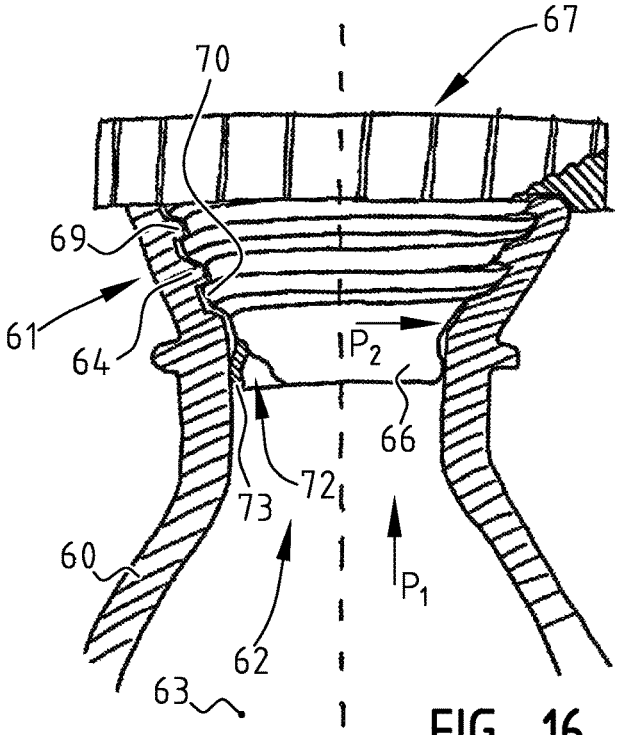
FIG. 16 shows a longitudinal section of an embodiment of a closing unit applied on a bottle with radially inward extending screw thread.

FIG. 16 shows another embodiment of the invention. In this embodiment the container is a bottle 60, on the upper outer end of which a first (lower) closing element 61 is integrally formed. Receiving part 64 of closing element 61 is formed by the outer end of the bottle extending all around the drinking opening of the bottle. Formed in receiving part 64 is a passage 62 along which the content 63 of the bottle can be carried outward (direction $P_1$) once the drinking opening has been opened. A closing part 66 of second (upper) closing element 67 can be arranged in receiving part 64. Formed on the inward facing side of receiving part 64 is first screw thread 69 which can engage on second screw thread 70 provided on the outward facing side of closing part 66. Closing part 66 can be coupled to receiving part 64 by being screwed into the receiving part using the screw thread.

In similar manner as in the above described embodiment, closing part 66 and receiving part 64 are embodied as a truncated cone. The narrow outer end of the closing part is located on the side of high pressure, i.e. on the inner side of the bottle, while the wide outer end of the closing part is located on the side of low pressure, i.e. on the outer side. Because of the conical form of the closing part and receiving element (and thereby of the first and second screw thread), the closing part can be coupled with relatively great closing force to the receiving element.

In the shown embodiment closing part 66 is provided on the underside with a cavity 72 in that closing part 66 takes a substantially annular form. The annular wall 73 of closing part 66 is preferably manufactured from flexible material, while the material of the bottle itself has a relatively great stiffness. The pressure inside the bottle which produces a radially outward directed force (direction $P_2$) on closing part 66 ensures that screw thread 70 is pressed extra-firmly against the corresponding screw thread of the receiving part so that a further improved seal can be realized in the case of high pressure in the bottle.

Figure 17:
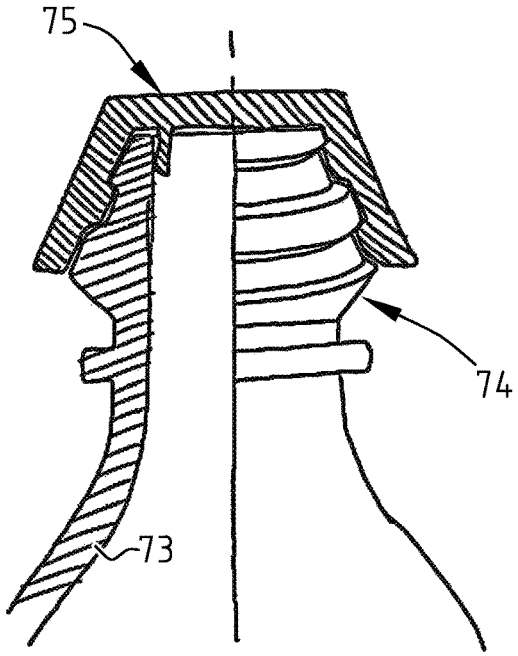
FIG. 17 shows a longitudinal section of another embodiment of a closing unit applied on a bottle with radially outward extending screw thread.

FIG. 17 shows another embodiment of the invention. In this embodiment the container is once again a bottle 73. A first (lower) closing element 74 is formed on the upper outer end of bottle 73. In the shown embodiment the closing element forms part of the bottle (i.e. is formed integrally therewith), although in other embodiments the first closing element can also be formed by a separate element. In this embodiment the closing part of second closing element 75 and the receiving part of the first closing element also have a conical form in order to make an improved seal possible (compared to usual cylindrical elements). With the same purpose the bottle, and thereby also first closing element 74, is manufactured in the shown embodiment from relatively flexible material, while second closing element 75 is manufactured from relatively stiff material. Owing to the high pressure inside the bottle (up to for instance a factor of 3 to 5 higher than outside the bottle) the receiving element presses radially outward and thus clamps itself firmly in the relatively stiff second closing element 75.

FIGS. 18-23 show a further embodiment of a closing unit 80. The embodiment is largely similar to those of FIGS. 1-15, and a detailed description of specific details of this embodiment is therefore omitted here for the sake of clarity. Closing unit 80 is intended for a beverage can and can be arranged on an end surface thereof. The closing unit comprises a first closing element 81, a second closing element 82 and an intermediate element 83 between the first and second closing elements.

Figure 22:
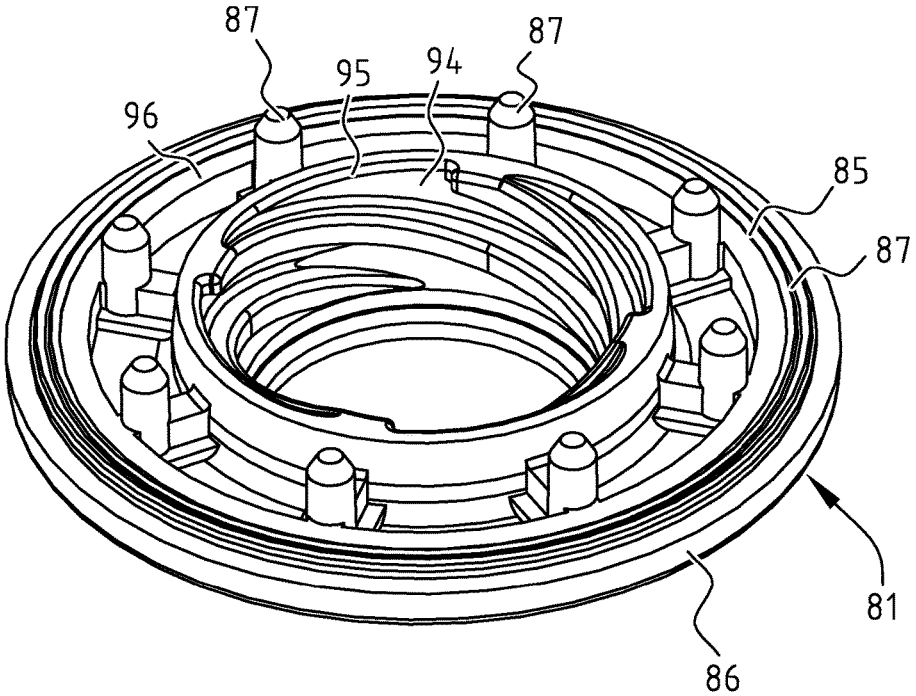
FIG. 22 is a top view of an embodiment of a first closing element.

Referring to FIG. 22, first closing element 81 comprises a disc-like component 85, along the peripheral edge 86 of which a peripheral sealing lip 87 is arranged. Seal lip 87 can be pressed against the underside of the end surface in order to seal the closing unit against the underside of the end surface of the beverage can. A number of upright attaching legs 87 are further provided on the disc-like component 85. These legs 87 can be guided through corresponding openings in the end surface of the beverage can and, via corresponding openings 90 in intermediate element 83 positioned on the upper side of the end surface, be attached to this intermediate element 83 (for instance by melting the outer ends of the legs).

Figure 18:
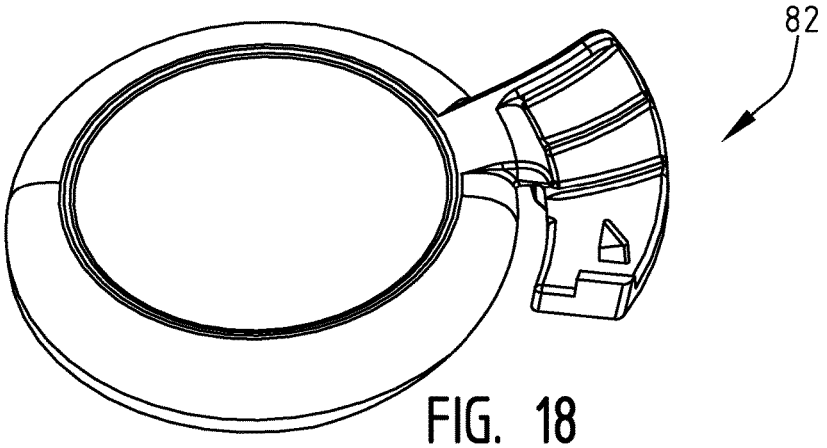
FIG. 18 is a top view of an embodiment of the second closing element.
Figure 19:
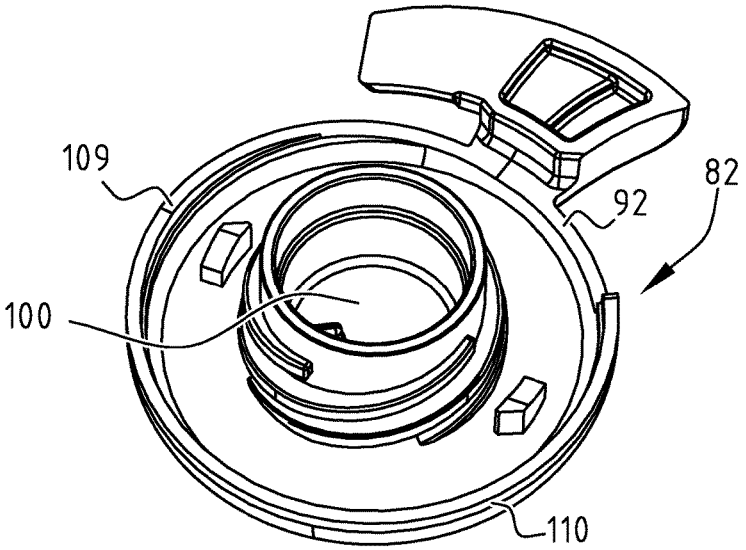
FIG. 19 is a bottom view of the embodiment of the second closing element of FIG. 18.
Figure 20:
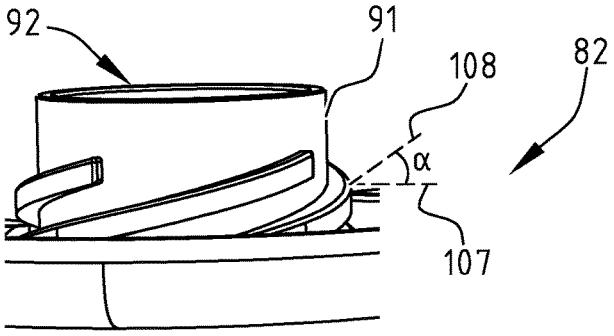
FIG. 20 is a side view of the closing element of FIGS. 18 and 19.
Figure 21:
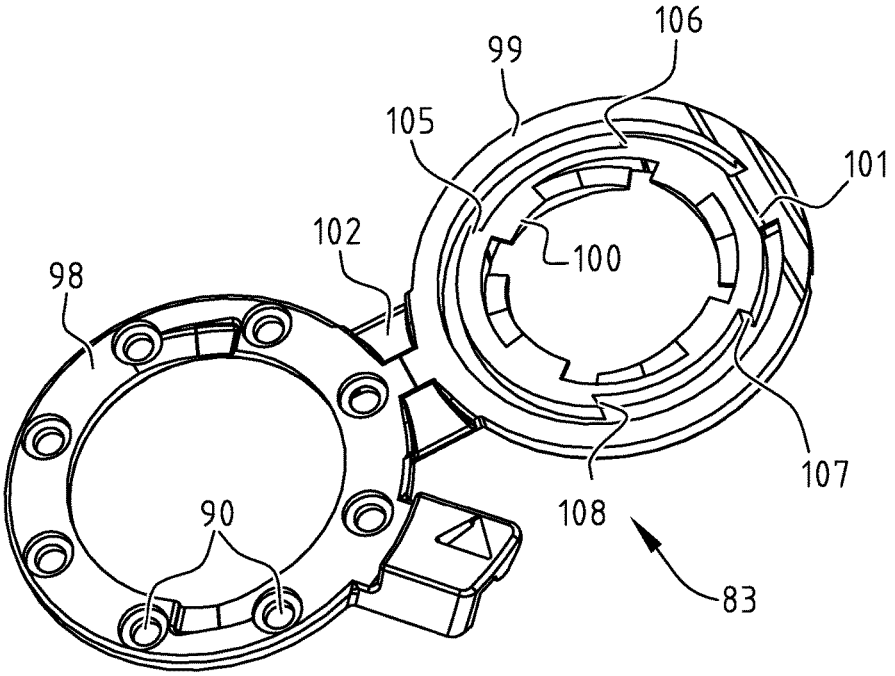
FIG. 21 is a top view of an embodiment of an intermediate element.

Referring to FIGS. 18-20, second closing element 82 comprises a closing part 91 comprising a substantially annular wall 92, on the outer side of which is arranged screw thread 93. In the shown embodiment this screw thread is a multiple (multi-thread) screw thread, more particularly four-thread screw thread. In other embodiments the number of threads can be smaller (i.e. one, two or three threads) or larger (five or more threads). Lower closing element 81 likewise comprises a receiving part 94 comprising an annular upright wall 95, on the inner side of which is arranged screw thread 96. In the shown embodiment screw thread 96 is also four-thread.

Intermediate element 83 comprises a first annular element part 98, a second annular element part 99 and a third annular element part 100. In the position shown in FIG. 21 the third annular element part 100 extends concentrically relative to the second annular element part 99 and is connected thereto via a hinge 101. This hinge has no preferred positions. Hinge 102 between the first and second element parts is however a bistable hinge and therefore has two different preferred positions (one opened position and one closed position). Annular part 100 is arranged rotatably on second closing element 82. Second closing element 82 can only be rotated through a limited angle relative to the annular part due to the presence of protrusions 109,110 (FIG. 19) on the underside of second closing element 82 and a number of stops 105-108 on third annular part 100. Clearly indicated in the shown embodiment is that relative rotation of the closing part and receiving part is possible over only a limited angle (in the drawing about 90 degrees). In order to ensure that there is still sufficient holding force to be able to absorb the high pressure inside the container, the screw thread must be able to engage over at least one full periphery. In other words, when the closing part is rotated 90 degrees in order to open or close the closing unit and the screw thread must be in engagement at least over one full periphery (360 degrees), four or more threaded screw thread (i.e. 360/90=4) must be applied.

Figure 23:
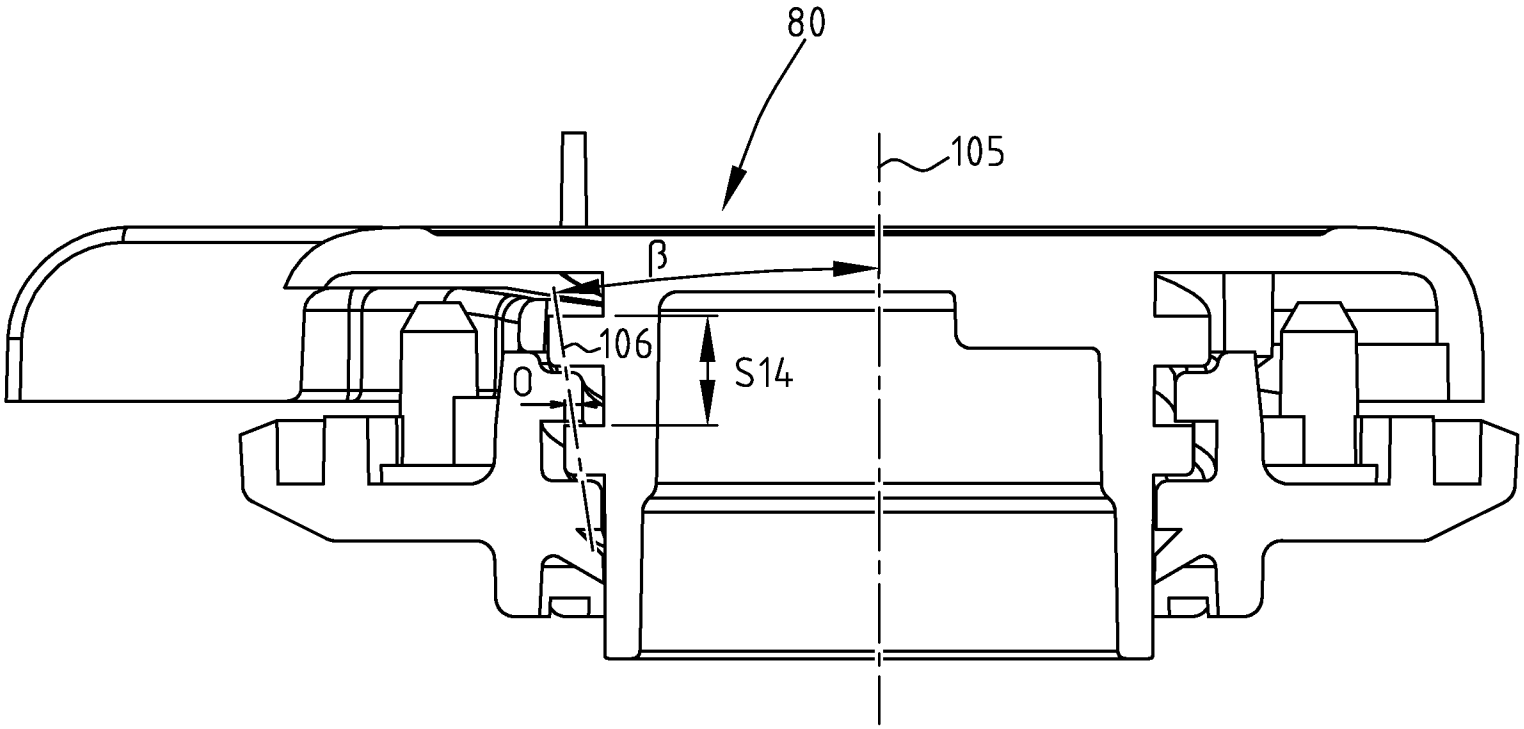
FIG. 23 shows a cross-section through the embodiment of the closing unit according to FIGS. 18-22.
Figure 24A:
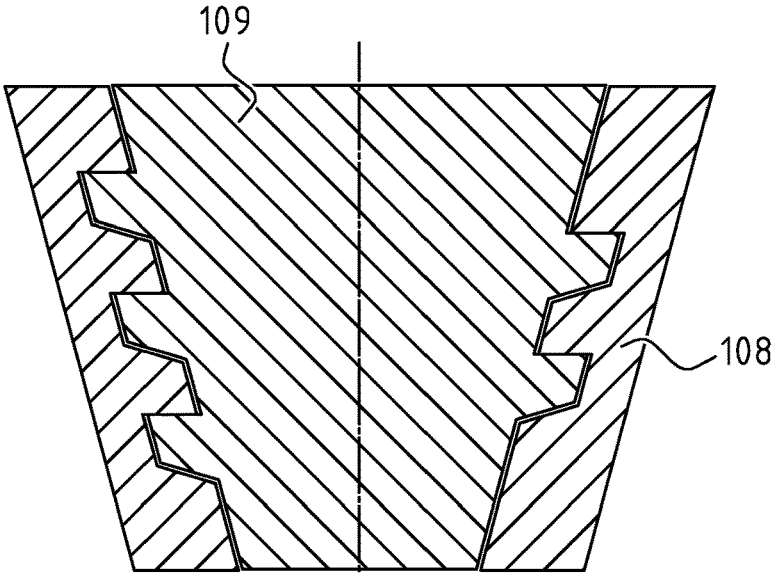
FIGS. 24A-D show respective sections of different geometries of the screw thread construction between a closing element and a receiving element.
Figure 24B:
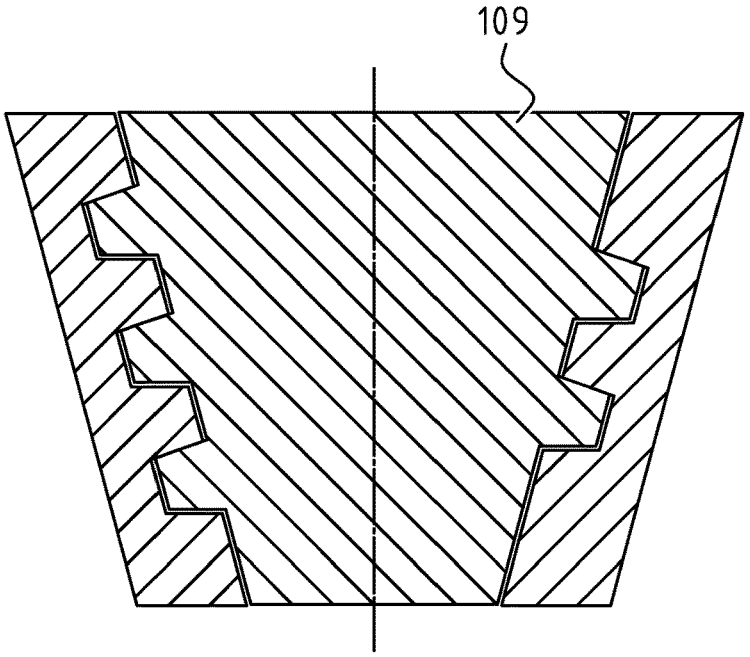
Figure 24C:
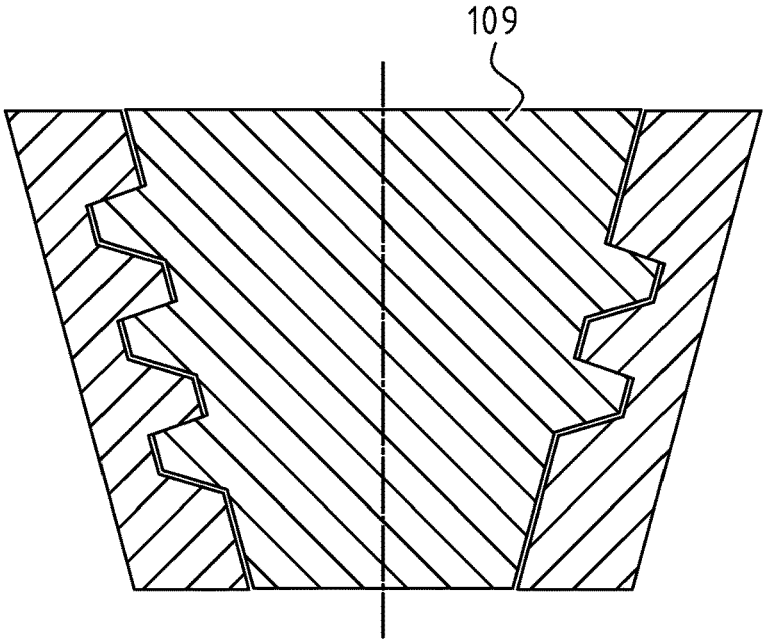
Figure 24D:
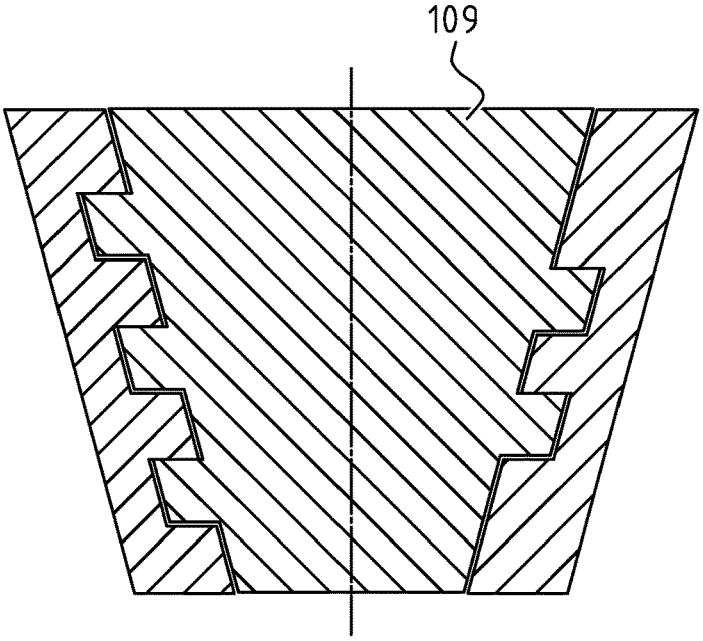
Figure 26:
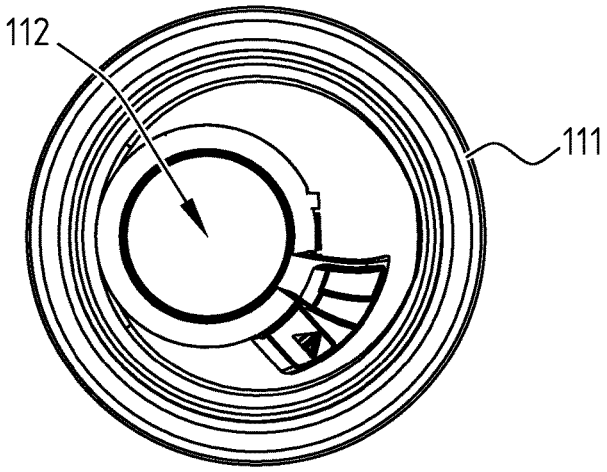
FIG. 26 is a top view of the beverage container with the closing unit according to FIG. 25.

Shown with reference to FIG. 23 is that the apex angle of the (truncated) cone of the substantially cone-shaped closing part/receiving part, i.e. twice the angle (β) between the axial direction 105 and a direction 106 tangentially of the peripheral side of the closing part and/or receiving part, preferably amounts to between 5 and 15 degrees, for instance between 8 and 10 degrees. An exceptionally good seal is found to be possible at these values of the apex angle, particularly when plastic material such as polypropylene is applied.

Shown in FIG. 20 is that the entry angle (α) of the screw thread (defined as the angle between the radial direction 107 and a direction 108 tangentially of the screw thread) varies from a relatively high value close to the free outer end of the closing part (i.e. at the relatively narrow upper outer end in the example of FIG. 20) to a relatively small value at the opposite outer end of the closing part (which in the specific example of FIG. 20 means at the relatively wide lower outer end of the receiving part). This makes it possible despite the conical shape of the receiving part/closing part to nevertheless realize a substantially constant pitch. In practical applications the pitch (S, FIG. 23) of the screw thread amounts to between 0.4 and 0.6 cm. In order to further provide for a sufficiently high holding force the thread overlap (O, see FIG. 23) of the first and second screw threads preferably amounts to between 0.4 and 1.0 cm, such as between 0.5 and 0.6 mm.

Shown in FIG. 19 is that the closing part has an annular form such that on the inner side a cavity 100 is present which connects to the inner side of the container. When the flexibility of wall 92 of the closing part is now sufficiently great and the flexibility of wall 95 of the receiving part (FIG. 22) is relatively low (stiff) (compared to wall 92 of the closing part), the closing part can be pressed increasingly more firmly against the receiving part as the pressure inside the container becomes higher, this enhancing the extent of the sealing provided by the closing unit.

FIGS. 24A-D show further different possible geometries (with for instance differing flank angles) of the screw thread between a receiving part 108 and a closing part 109. It lies within the reach of the skilled person to select a suitable geometry subject to the specific application and the requirements set in the application (for instance in respect of holding force, force necessary to open the unit, force necessary to close the unit and the like).

FIGS. 25-30 show a further embodiment of a beverage container 111 provided with a closing unit 112 according to an embodiment of the invention. Referring to, among others, FIG. 25A, the closing unit comprises a first closing element 113 (indicated in the figures with a darker hatching) and a second closing element 114 (indicated in the figures with a light hatching). First closing element 113 is attached to end wall 115 of container 111, as will he set forth below. An intermediate element 116 is arranged between first closing element 113 and second closing element 114. This intermediate element connects the first and second closing elements 113, 114 in both the opened and closed position of the container.

Figure 30:
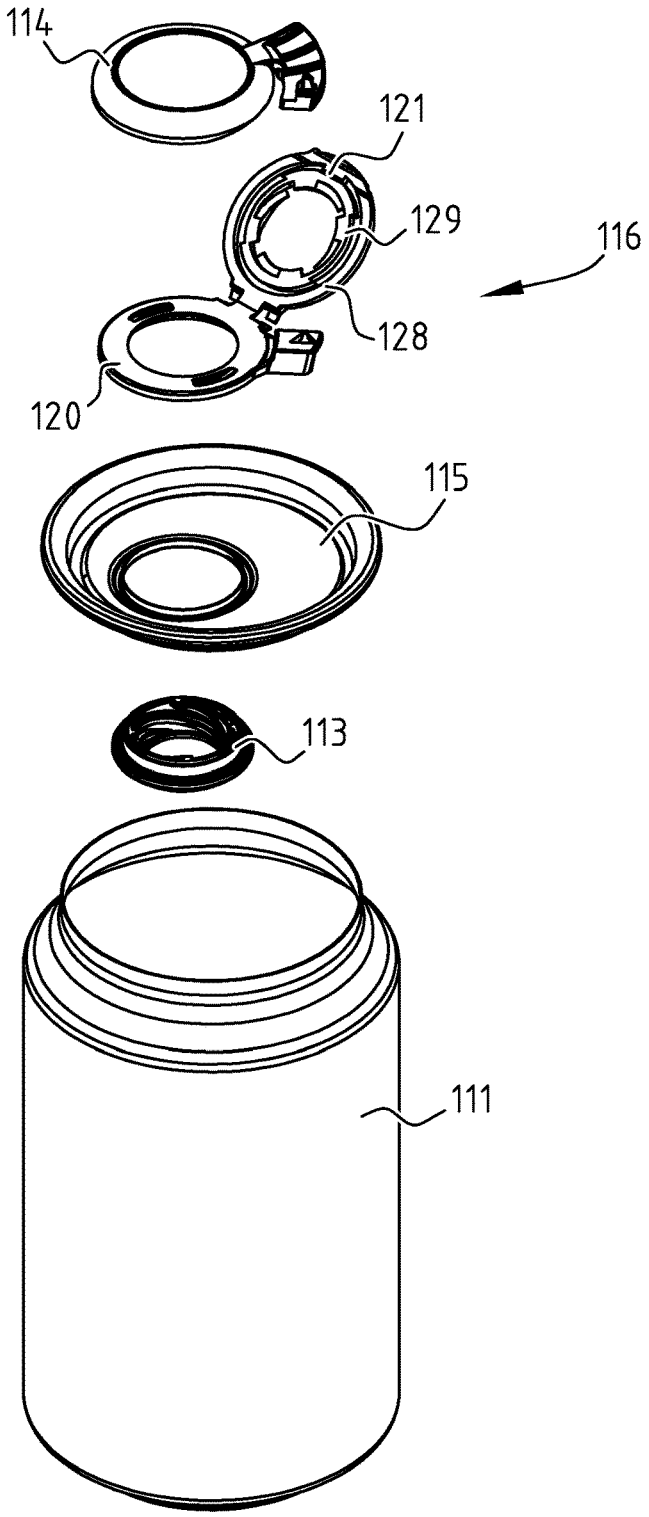
FIG. 30 is an exploded perspective view of the embodiment of FIG. 25.

In the shown embodiment intermediate element 116 comprises an element part 128 which is connected via a hinge 130 to first closing element 113 and a second element part 129 which is connected via a hinge 121 to first element part 128. Both element parts 128,129 are substantially annular, wherein second element part 129 takes a slightly smaller form than first element part 128 so that second element part 129 can be pivoted into first element part 128 (as shown in FIG. 30).

Figure 25A:
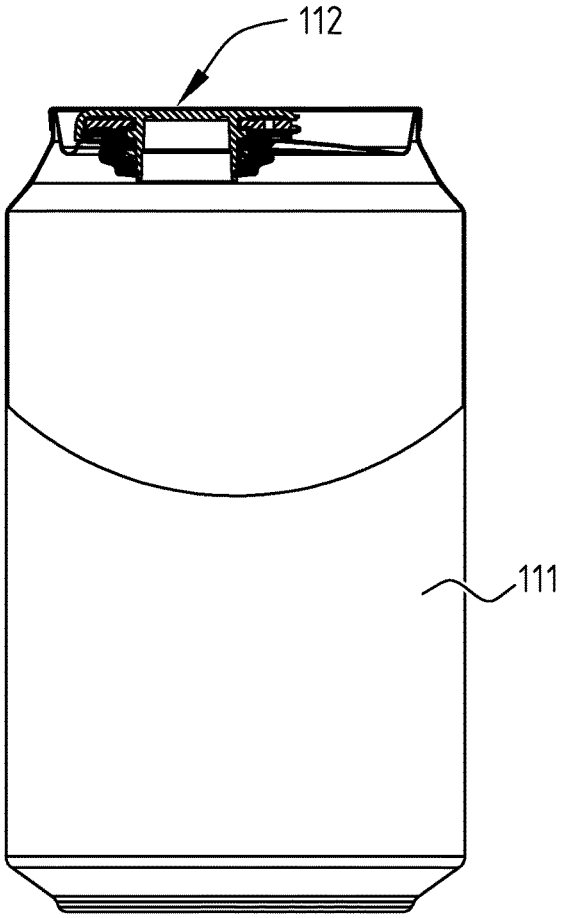
FIG. 25A shows a beverage container 110 provided with a further embodiment of a closing unit according to the invention.
Figure 25C:
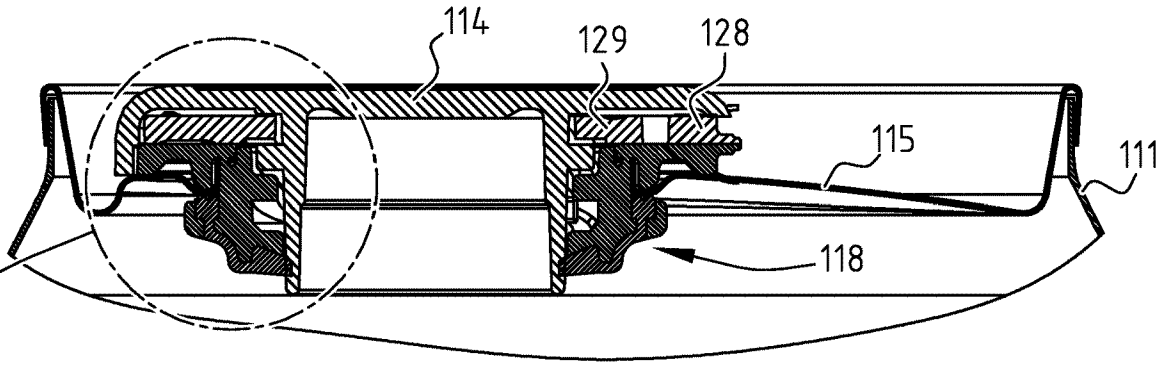
FIG. 25C shows a detail of the cross-section of FIG. 25A.
Figure 28:
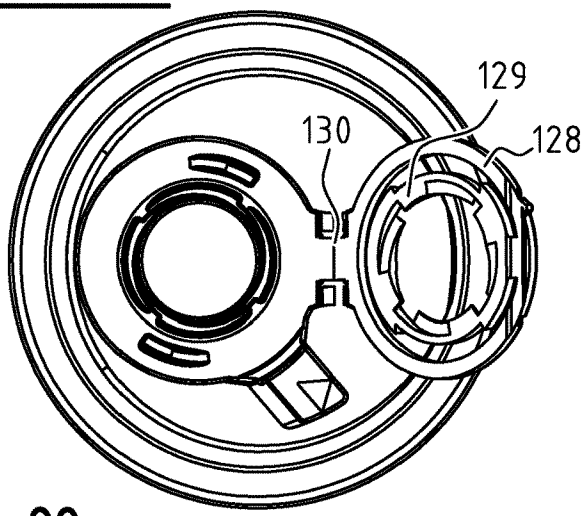
FIG. 28 shows a top view.
Figure 25B:
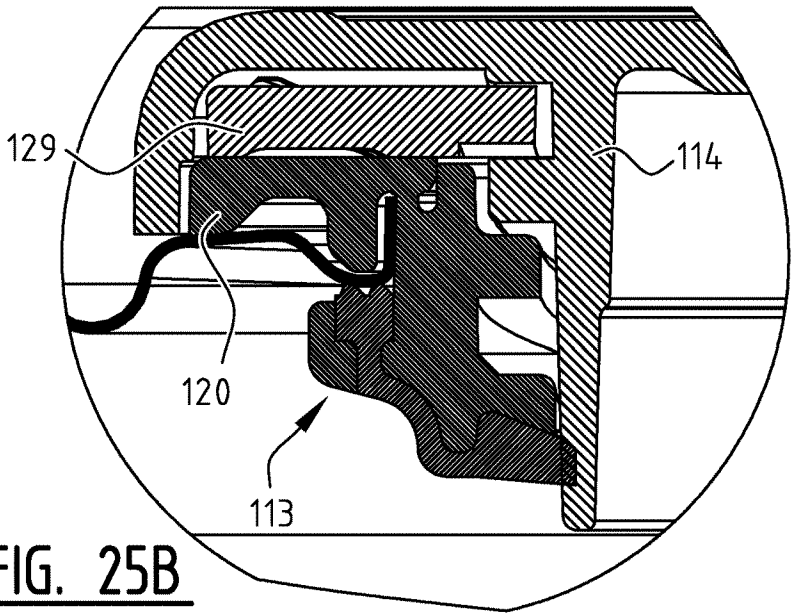
FIG. 25B shows a detail section along B in FIG. 24.
Figure 27:
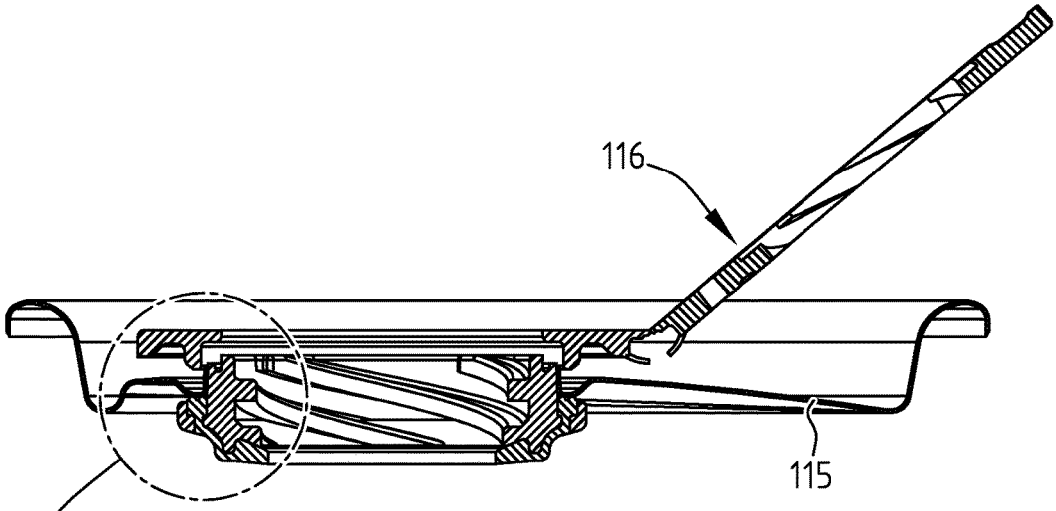
FIG. 27 shows a cross-section of the embodiment of the closing unit according to FIGS. 25-26 in an intermediate manufacturing step.
Figure 27A:
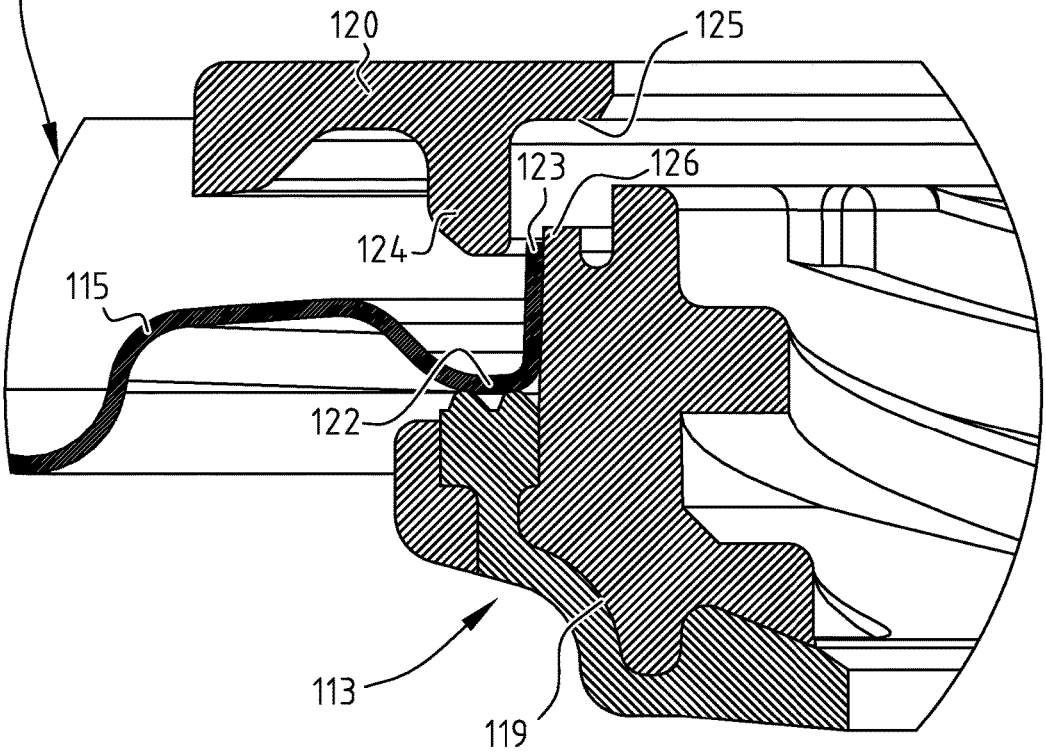
FIG. 27A shows a detail at the position C (see FIG. 27)
Figure 29:
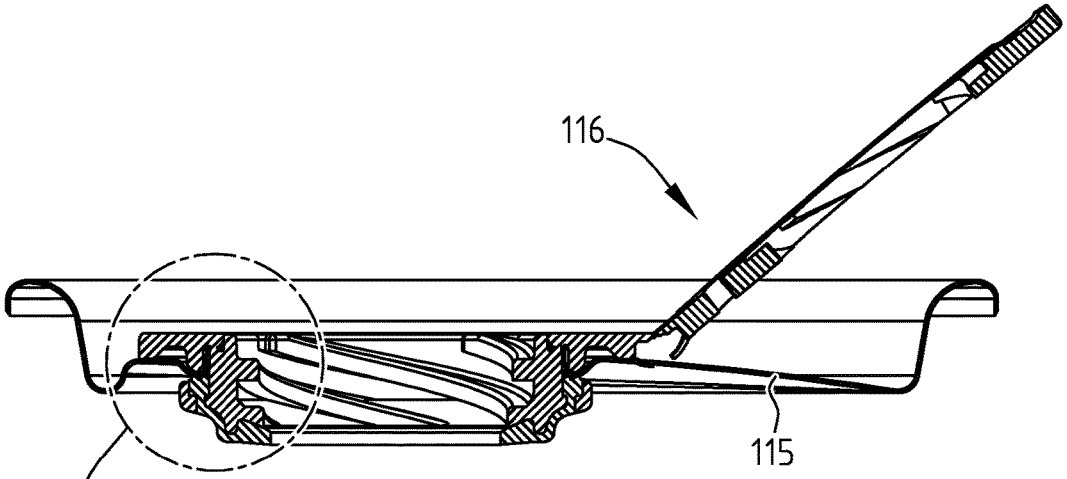
FIG. 29 is a side view of the embodiment of FIG. 28 in mounted position.
Figure 29A:
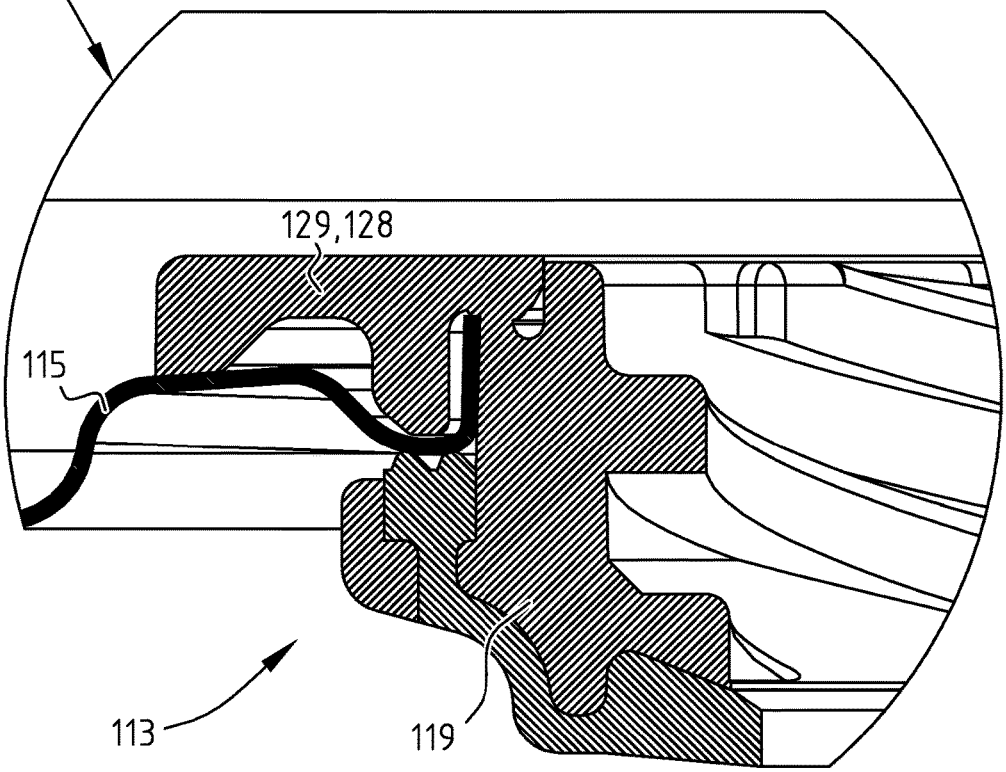
FIG. 29A shows a detail at the position D.

First closing element 113 comprises a substantially annular plastic element 119 arranged on the underside against end wall 115 of beverage container 111. This plastic element is formed such that it can be placed against an upright outer end 123 of end wall 115 of beverage container 111. First closing element 113 further comprises a substantially annular element part 120 arranged against the upper side of end wall 115. This element 120 forms the receiving part with throughflow opening in which the closing part of the cap (i.e. second closing element 114) can be placed. Receiving part 120 comprises a downward extending protrusion 124 which can be placed in a notch 122 in wall 115. Shown in FIGS. 27/27A is the situation just before receiving element 120 is placed against wall 115. Once receiving element 120 has been placed on the upper side of wall 115 and element 119 on the underside of wall 115, they can be coupled to each other. Coupling can be realized at the position of surfaces 125 on receiving element 121 and surface 126 on element 119, for instance by welding the two elements 119, 122 to each other until the position shown in FIG. 25 is reached. In this latter position a compact and liquid-tight seal is effected between lower element 113 and wall 115 of beverage container 111.

A lower material consumption can be realized compared to a number of the above embodiments, for instance as described with reference to FIGS. 1-15. The alternative design is further embodied such that less liquid is left behind in the beverage container. Finally, the user is inconvenienced less by the presence of the closing unit, this enhancing the drinking comfort.

The invention is not limited to the embodiments thereof described herein. Numerous adjustments, modifications and additions can be envisaged, all falling within the scope of the following claims.

The invention claimed is:

1. Closing unit for a throughflow opening of a beverage container, the closing unit comprising:

a first closing element configured to be mounted or integrally formed on the beverage container, wherein the first closing element comprises a receiving part comprising a wall, the receiving part provided with a passage and to be arranged in or round the throughflow opening, the throughflow opening being a drinking or pouring opening of the beverage container;

a second closing element comprising a closing part configured to be received by the receiving part and to be coupled releasably thereto for the purpose of closing or leaving clear the drinking or pouring opening;

wherein the wall of the receiving part comprises a conical screw thread disposed on its surface, wherein the closing part of the second closing element comprises a substantially annular downward extending part with an external conical screw thread disposed on its outer surface, wherein the downward extending part of the second closing element comprises a hollow space defined therein such that when the second closing element is engaged with the first closing element, the hollow space is exposed to the volume of the beverage container, wherein the flexibility of the wall of the receiving part of the first closing element is lower than the flexibility of the downward extending part of the closing part of the second closing element such that when the second closing element is engaged with the first closing element, the downward extending part of the second closing element is configured to move in a radial direction against the wall of the first closing element due to the pressure inside of the beverage container, and wherein the conical screw threads disposed on the first and second closing elements are configured to be threadbly engaged with each other such that the conical screw threads of the second closing element are pressed increasingly more firmly against the conical screw threads of the first closing element in a radial direction relative to a longitudinal axis of the hollow space defined in the second closing element as the pressure inside the beverage container increases.

2. Closing unit as claimed in claim 1, wherein the apex angle (2β) of the cone of the conical screw thread amounts to between 5 and 20 degrees.

3. Closing unit as claimed in claim 1, wherein conical screw thread disposed on the first and second closing elements is a multi-thread screw thread and the multi-thread screw thread is embodied to couple or uncouple the closing part and receiving part over substantially the whole periphery with a rotation of the closing part and receiving part relative to each other over an angle of less than 90 degrees.

4. Closing unit as claimed in claim 1, wherein the ratio of the thread overlap O and the pitch S is smaller than 2*tangent (β), wherein β equals the half-apex angle of the cone.

5. Closing unit as claimed in claim 1, wherein the closing part is embodied such that the unscrewing angle θ is approximately equal to:

$$(O*180°)/(S*\tan(\beta)),$$

with S being the thread pitch, β the angle of conicity, O the thread overlap and n the number of threads of the screw thread.

6. Closing unit as claimed in claim 1, wherein the conical screw threads take a self-braking form and/or wherein, substantially irrespective of the magnitude of the axial force exerted on the closing element, the second closing element will not unscrew of its own accord.

7. Closing unit as claimed in claim 1, wherein the entry angle α is equal to arc tangent (f) plus or minus 25%, wherein f is equal to the effective coefficient of friction between the conical screw threads of the first and second closing elements, in particular between two overlapping thread parts which support on each other or lie against each other and/or wherein the average entry angle α of the screw thread is such that the effective coefficient of friction between the screw thread of the first closing element and the screw thread of the second closing element is greater than the tangent of the entry angle α, wherein the average entry angle α is defined as:

$$\alpha=\arctan(\text{pitch } S/(\pi*\text{average screw thread diameter})).$$

8. Closing unit as claimed in claim 1, wherein the effective coefficient of friction between the screw thread of the first closing element and the screw thread of the second closing element is 15-30% greater than:

$$\text{pitch } S/(\pi*\text{average screw thread diameter}).$$

9. Closing unit as claimed in claim 1, wherein a single-thread or multi-thread screw thread of the threaded coupling is arranged so as to engage on each other over the whole periphery of the receiving part and closing part.

10. Closing unit as claimed in claim 1, wherein the entry angle (α) of the screw thread varies from a relatively high value close to the free outer end of the closing part and a relatively low value at the opposite outer end of the closing part.

11. Closing unit as claimed in claim 1, wherein the thread overlap (O) of the conical screw threads of the first and second closing elements amounts to between 0.4 and 1.0 mm and/or wherein the pitch (S) of the screw thread amounts to between 8 and 20 mm.

12. Closing unit as claimed in claim 1, wherein an intermediate element is arranged between the first closing element and the second closing element, wherein the intermediate element comprises:

a first element part coupled to the first closing element;

a third element part coupled to the second closing element; and a second element part coupled to both the first and third element parts via a corresponding hinge, wherein the hinge coupling the second element part to the third element part is positioned opposite the hinge coupling the first element part to the second element part, wherein the hinge coupling the first element part to the second element part is a bistable hinge configured to hold the closing unit in stable manner in either a closed position or an opened position, and wherein the first, second, and third element parts are each concentrically disposed about the throughflow opening when the closing unit is in a closed position.

13. Closing unit as claimed in claim 12, wherein the intermediate element is configured to pivot the closing part of the second closing element between a closed position substantially closing the passage in the first closing element with the closing part and an opened position substantially keeping open the passage in the first closing element.

14. Closing unit as claimed in claim 12, wherein the closing part is mounted rotatably on the third element part and comprising screw thread which is formed on the closing part and which engages on corresponding screw thread of the first closing element during rotation of the closing part.

15. Closing unit as claimed in claim 1, wherein the first closing element comprises at least a stop for limiting the angle of rotation of the closing part.

16. Closing unit as claimed in claim 1, wherein the first closing element comprises a cover configured to accommodate at least a portion of the closing part of the second closing element and prevent removal of the closing part until the closing part has been rotated through a preset minimum angle relative to the first closing element.

17. Closing unit as claimed in claim 1, wherein the first closing element and/or the second closing element are manufactured substantially or wholly from plastic and/or are constructed from injection-moulded components.

18. Beverage container provided with a closing unit as claimed in claim 1.

* * * * *